US011332968B2

(12) United States Patent
Nevetscherov et al.

(10) Patent No.: US 11,332,968 B2
(45) Date of Patent: May 17, 2022

(54) DRIVE CARRIAGE FOR A DOOR AND DOOR DRIVE

(71) Applicant: Marantec Antriebs- und Steuerungstechnik GmbH & Co. KG, Marienfeld (DE)

(72) Inventors: Arkady Nevetscherov, Bielefeld (DE); Michael Hoermann, Halle Westfalen (DE)

(73) Assignee: Marantec Antriebs- und Steuerungstechnik GmbH & Co. KG, Marienfeld (DE)

( * ) Notice: Subject to any disclaimer, the term of this patent is extended or adjusted under 35 U.S.C. 154(b) by 36 days.

(21) Appl. No.: 16/569,552

(22) Filed: Sep. 12, 2019

(65) Prior Publication Data

US 2020/0080359 A1 Mar. 12, 2020

(30) Foreign Application Priority Data

Sep. 12, 2018 (DE) ..... 20 2018 105 217.9

(51) Int. Cl.
*E05F 15/60* (2015.01)
*E05F 15/67* (2015.01)
*E05F 15/681* (2015.01)

(52) U.S. Cl.
CPC ..... *E05F 15/60* (2015.01); *E05F 15/67* (2015.01); *E05F 15/681* (2015.01); *E05Y 2900/106* (2013.01)

(58) Field of Classification Search
CPC .. E05Y 2900/106; E05F 15/681; E05F 15/60; E05F 15/67
See application file for complete search history.

(56) References Cited

U.S. PATENT DOCUMENTS 3,858,452 A * 1/1975 Gatland ..... E05F 15/673 74/424.78
4,414,778 A * 11/1983 Carli ..... E05F 15/67 49/199
4,520,684 A * 6/1985 Meyer ..... E05F 15/67 74/89.21

(Continued)

FOREIGN PATENT DOCUMENTS

DE 19635153 C1 11/1997
DE 102007025723 B3 9/2008

(Continued)

*Primary Examiner* — Justin B Rephann

(74) *Attorney, Agent, or Firm* — McCoy Russell LLP

(57) ABSTRACT

A drive carriage for a door, in particular garage door, comprising a body which is linearly shiftably mountable in a rail of a door drive, and a door driver pivotally mounted on the body, wherein a carriage driver which is shiftable relative to the body and is connectable with a power transmission means of the door drive, a latch mounted in the body via a flexible element and is pushable into a recess of the carriage driver by the flexible element, and a latching slide which urges the latch against the flexible element into an unlocking position in which the latch is not pushed into the recess by the flexible element, and which in a drive position permits pushing of the latch into the recess of the carriage driver by the flexible element in order to take a locking position in which the carriage driver is coupled with the body.

19 Claims, 4 Drawing Sheets

(56) References Cited

U.S. PATENT DOCUMENTS

| | | | | | |
|---|---|---|---|---|---|
| 4,628,636 | A * | 12/1986 | Folger | E05F 15/41 | 49/199 |
| 4,653,565 | A * | 3/1987 | Iha | E05F 15/686 | 160/193 |
| 4,905,542 | A * | 3/1990 | Burm | E05F 15/668 | 104/120 |
| 6,557,301 | B1 * | 5/2003 | Hermann | E05B 65/0021 | 49/139 |
| 8,936,064 | B1 * | 1/2015 | Diaz | E05F 15/681 | 160/201 |
| 2002/0088682 | A1 * | 7/2002 | Chang | E05F 15/681 | 192/30 R |
| 2005/0120629 | A1 * | 6/2005 | Chang | E05F 15/681 | 49/197 |
| 2012/0019011 | A1 * | 1/2012 | Laborde | E05B 13/001 | 292/1 |
| 2012/0299519 | A1 * | 11/2012 | Krupke | E05F 15/684 | 318/434 |
| 2016/0340946 | A1 * | 11/2016 | Hill | E05F 15/668 | |

FOREIGN PATENT DOCUMENTS

| | | | |
|---|---|---|---|
| EP | 1398448 | A2 | 3/2004 |
| EP | 2863000 | A1 | 4/2015 |

* cited by examiner

DRIVE CARRIAGE FOR A DOOR AND DOOR DRIVE

CROSS REFERENCE TO RELATED APPLICATION

The present application claims priority to German Application No. DE 10 2018 105 217.9 entitled "DRIVE CARRIAGE FOR A DOOR AND DOOR DRIVE," filed on Sep. 12, 2018. The entire contents of the above listed application are hereby incorporated by reference for all purposes.

TECHNICAL FIELD

The present disclosure relates to a drive carriage for a door, in particular a garage door, and to a door drive comprising such a drive carriage.

BACKGROUND AND SUMMARY

Drive carriages for door drives are known from the prior art. Such drive carriages are complex devices, as they must realize several tasks at the same time. First of all, the drive carriage is the mechanical link between the linear movement of the force-transmitting driven components (e.g. chain or toothed belt) and the door moved via a door driver rod. Furthermore, it must be possible to decouple the door from the force-transmitting driven component in cases of emergency or for a manual operation, and to recouple the same. Finally, a drive carriage must comprise a locking function which is meant to prevent the door from being pushed open from outside. The latter function can also be realized by other, expensive solutions at the door or in the motor of the door drive.

To combine these functions in a single component, generic drive carriages typically consist of many different components made of plastics and/or metal, which are expensive to manufacture and to mount. For example, most of the drive carriages are configured as multipart plastic constructs screwed to each other, in which the complex inner workings are incorporated.

Against the background it is the object of the present disclosure to provide a drive carriage which consists of as few individual parts as possible, which can be mounted easily.

According to the disclosure, this object is achieved by a drive carriage for a door, in particular garage door. Accordingly, the drive carriage according to the disclosure comprises a body which is linearly shiftably mountable in a rail of a door drive, and a door driver which is pivotally mounted on or in the body and is connectable with the door.

According to the disclosure, the drive carriage furthermore comprises a carriage driver which is shiftable relative to the body and is connectable with a power transmission device of the door drive, a latch which is mounted in the body via a flexible element and in the case of an overlap can be pushed into a corresponding recess of the carriage driver by the flexible element, and a latching slide which can take a free-wheeling position and a drive position. In the free-wheeling position the latching slide urges the latch against the flexible element into an unlocking position in which in the case of an overlap with the recess of the carriage driver the latch is not pushed into the recess by the flexible element. In the drive position, on the other hand, the latching slide in the case of an overlap permits pushing of the latch into the recess of the carriage driver by the flexible element in order to take a locking position. In the locking position of the latch, the carriage driver is coupled with the body, i.e. a linear movement of the power transmission device of the door drive, with which the carriage driver is coupled, leads to a more or less linear movement of the body or of the drive carriage in the rail of the door drive.

By the configuration of the carriage driver, the latch and the latching slide according to the disclosure a particularly simple construction of the drive carriage is achieved and numerous components can be saved. By shifting the latching slide from the drive position into the free-wheeling position, the drive carriage can be decoupled from the power transmission device of the door drive so that a manual operation or manual opening and closing of the door coupled with the drive carriage via the door driver is possible. The body moves independent of and relative to the carriage driver. The latch cannot engage into the recess of the carriage driver so that there is no coupling between body and carriage driver.

By subsequently bringing the latching slide back into the drive position, the latch can be pressed into the recess of the carriage driver by means of the flexible element as soon as body and carriage driver come into a relative position in which the recess of the carriage driver overlaps the latch. Body and carriage driver thereby are again coupled with each other, and a linear movement of the carriage driver driven by the power transmission device of the door drive is transmitted to the body. Thus, the door can again be opened and closed mechanically by means of the door drive.

Due to the simple construction an assembly of the drive carriage according to the disclosure can be effected quickly and easily and in particular without using any special tools. For the assembly at least of the coupling mechanism of the drive carriage according to the disclosure it is merely necessary to insert latching slide and latch (along with the flexible element) into each other. The small number of individual parts also saves costs.

Advantageous embodiments of the disclosure can be taken from the sub-claims and the following description.

In one embodiment it is provided that the latching slide includes a connecting link guide along which the latch is positively guided when the latching slide is brought from the free-wheeling position into the drive position and vice versa. This results in a simple positive coupling of latching slide and latch.

In another embodiment it is provided that the direction of movement of the latching slide when switching between free-wheeling position and drive position is perpendicular to the direction of movement of the latch when switching between locking position and unlocking position. The movements of latching slide and latch hence are coupled with each other and independent of each other.

In another embodiment it is provided that the latching slide includes a latching nose which prevents a release of the connection between latching slide and latch. Thus, latching slide and latch mutually hold and fix each other, and a release of the two components from a positive connection is prevented in a simple way. In addition, a particularly simple joining of latching slide and latch becomes possible, as the two parts simply snap in place after being pushed into each other. Tools are not needed to produce the connection.

In another embodiment it is provided that the latching slide includes a receiving device for receiving an actuating element by means of which the latching slide can be brought from the free-wheeling position into the drive position and vice versa. The actuating element for example can be a cable or a wire by means of which an engagement or disengagement or shifting of the latching element can be carried out over a certain distance.

The latching slide furthermore may comprise a securing device by means of which the actuating element can be fixed on or in the receiving device. The receiving device alone for example can receive a cable which is provided with a knot, a ball or a similar element that by form fit prevents the actuating element from slipping out of the receiving device. The securing device now serves to additionally secure the actuating element or to fix an actuating element which does not have such a stopper, for example a cable without ball, knot or the like.

In another embodiment it is provided that the body comprises a rail into which the carriage driver can be retracted and can be shiftably mounted relative to the body, wherein the rail in particular is aligned parallel to the direction of movement of the drive carriage in a door drive.

In another embodiment it is provided that in the locking position with the carriage driver not present in the rail the latch protrudes into the rail. In the unlocking position on the other hand the latching slide urges the latch back in the direction of the body against the tension of the flexible element so that the carriage driver can move freely in the rail. There is no coupling in the case of an overlap of the recess and the latch.

In another embodiment it is provided that the carriage driver includes bevels by which the latch disposed in the locking position when the carriage driver is inserted into the rail of the body is urged into the body against the flexible element, wherein the relative movement between carriage driver and body can be continued until the recess is disposed at the level of the latch and the same is pressed into the recess by the flexible element. Hence, the latch cannot be brought into the locking position even when the carriage driver is not disposed in the rail. As soon as the carriage driver moves into the rail of the body, the latch protruding into the rail is urged in the direction of the body by the bevel at the ends of the carriage driver. When the continued movement of the carriage driver results in an overlap of its recess and the latch, the same is pressed into the recess by means of the flexible element, whereupon the body is coupled with the carriage driver. This coupling mechanism represents a particularly simple design solution with only few movable parts.

In another embodiment it is provided that the latching slide engages into a recess of the latch and by form fit delimits a movement of the latch enabled by the flexible element.

In another embodiment it is provided that the body is configured in one piece. This results in a robust construction of the drive carriage with only few individual parts and correspondingly a quick and easy assembly. The body for example can be made of plastics.

In another embodiment it is provided that the flexible element is a spring, for example a metal spring.

In another embodiment it is provided that a large part of the components of the drive carriage, in particular latching slide, latch, carriage driver and body, are made of plastics. As a result, the components of the drive carriage can be manufactured at low cost (e.g. by injection molding methods or in mass production). At the same time, a weight saving is obtained.

In another embodiment it is provided that the door driver is configured as a rod and includes a bolt element at the end facing away from the door, by means of which the door driver is releasably mounted in a recess of the body and pivotable about the longitudinal axis of the bolt element. Optionally, the door driver is arranged on the underside of the body and centrally as seen perpendicularly to the direction of movement of the drive carriage. The door to be moved can be fastened to the other end of the door driver. For this purpose, the door driver rod may be bent so that opening of the door does not lead to a collision with the door driver, in particular in the region of the open position of the door.

The present disclosure furthermore comprises a door drive for a door, in particular for a garage door, comprising a drive motor, a rail, a power transmission device, in particular a toothed belt, and a drive carriage according to any of the preceding claims, which is shiftably mounted in a rail and is linearly movable by means of the power transmission device.

BRIEF DESCRIPTION OF FIGURES

Further features, details and advantages of the disclosure can be taken from the exemplary embodiment explained with reference to the Figures. In the drawing.

DETAILED DESCRIPTION

Figure 1:
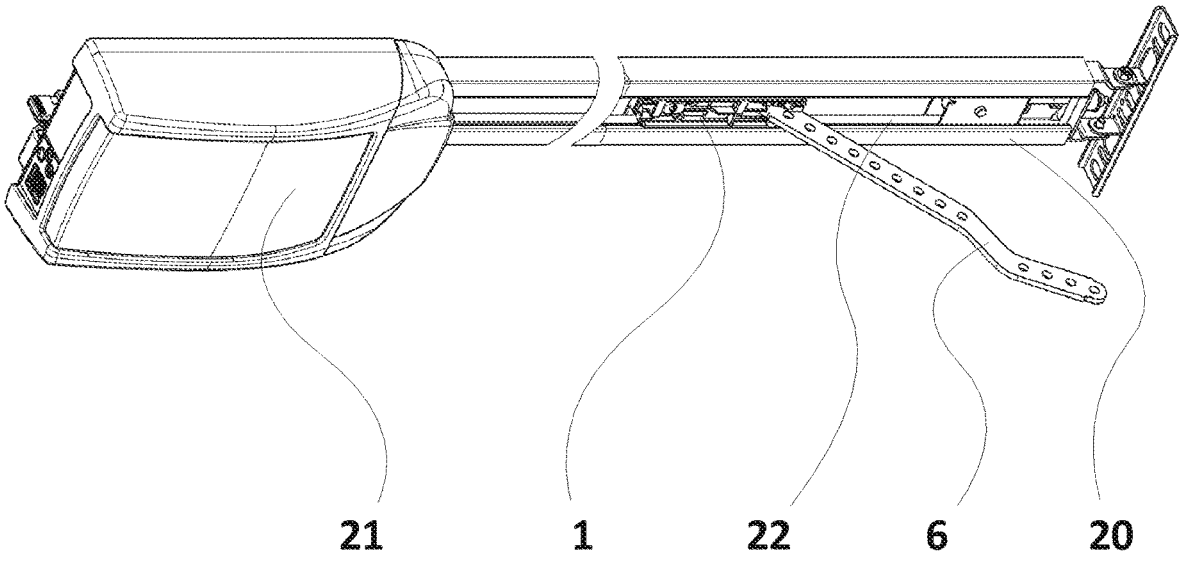
FIG. 1 shows an exemplary embodiment of the door drive of the disclosure with a drive carriage of the disclosure in a perspective view.

FIG. 1 shows an exemplary embodiment of the door drive according to the disclosure, which comprises a motor unit with a drive motor 21 which drives a power transmission device 22 configured as a toothed belt which moves along a rail 20 proceeding from the drive motor 21. In the rail 20 a drive carriage according to the disclosure is shiftably mounted, which is linearly movable by the linear movement of the toothed belt 22. The drive carriage includes a door driver 6 configured as a bent rod, which is articulated to a door (not shown) and produces a connection between drive carriage and door. Thus, the door can be opened and closed by means of the drive motor 21. For assembly, the drive carriage is pushed into the rail 20.

In the following, an exemplary embodiment of the drive carriage according to the disclosure will now be described with reference to FIGS. 2-4.

Figure 2:
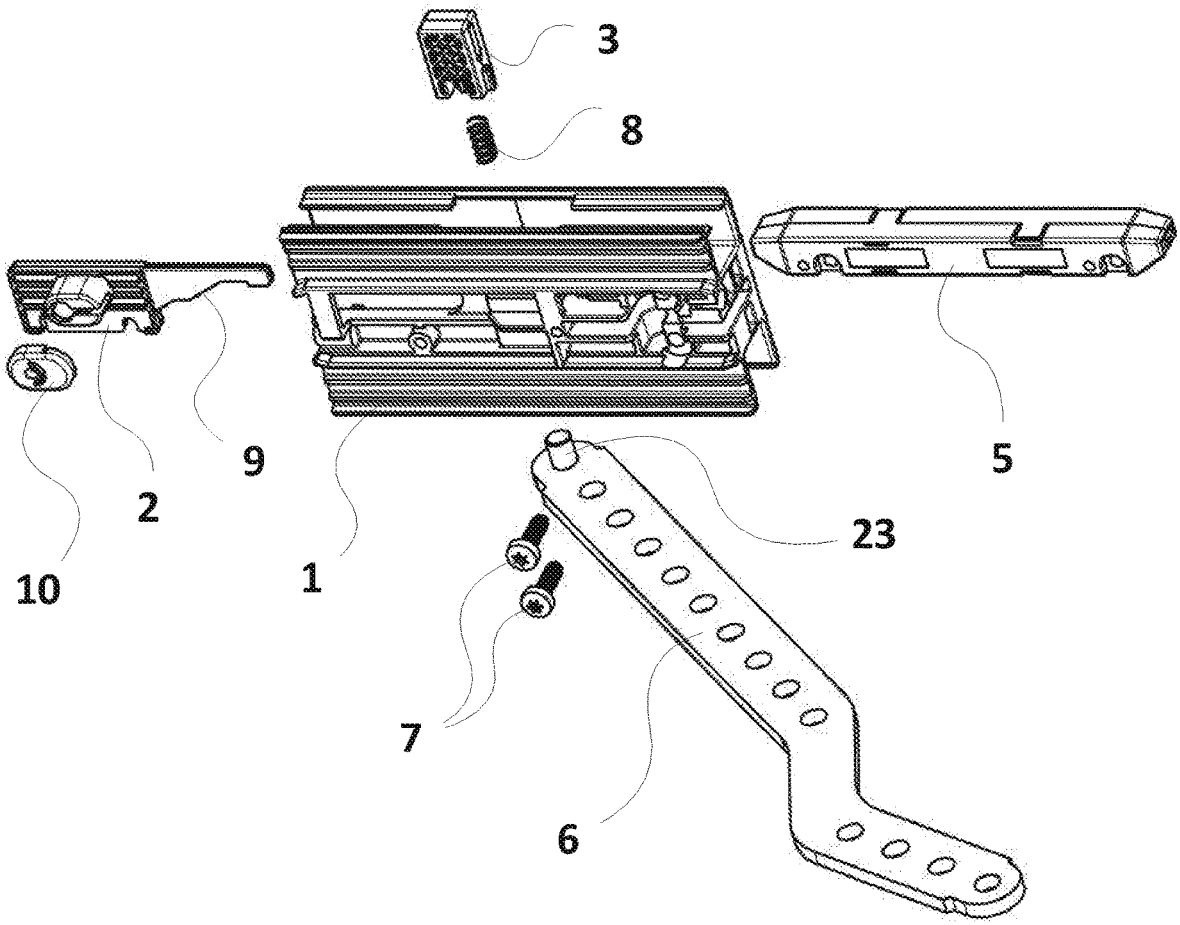
FIG. 2 shows an exemplary embodiment of the drive carriage of the disclosure in a perspective exploded view.

FIG. 2 shows a perspective exploded view of the drive carriage according to the disclosure, which comprises a one-part body 1, a carriage driver 5 connectable or connected with the toothed belt 22 of a door drive, a door driver 6 connectable with a door, a latch 3 and a latching slide 2. FIGS. 3 and 4 show the drive carriage in the assembled condition in a perspective view and in a cross-sectional top view of the underside of the body 1.

In the body 1 of the drive carriage the door driver 6 configured as a bent rod is mounted in a recess on the underside of the body 1 via a bolt element 23 with two screws 7. The recess is located centrally in the body 1 as seen perpendicularly to the direction of movement of the drive carriage or the carriage driver 5 so that the door driver 6 does not collide with the rail 20 of the door drive, which is open on its underside. The door to be moved is to be fastened to the door driver 6 so that the drive carriage is connected with the door.

The body 1 includes a recess 4 oriented along an axis aligned perpendicularly to the direction of movement of the drive carriage, into which a latch 3 comprising a flexible element 8 configured as a spring is inserted. The spring 8 urges the latch 3 away from the body 1 and out of the recess 4. The latch 3 is held by the latching slide 2 which includes a connecting link guide 9 aligned along the direction of movement of the drive carriage, which engages into a slot-shaped recess of the latch 3. At the end of the connecting link guide 9 a latching nose is disposed, which prevents a release of the connection between latching slide 2 and latch 3. The latching slide 2 hence is held at the latch 3 by means of the latching nose such that the latching slide 2 is fixed in this position and the latch 3 is fixed at the same time. This results in a very easy assembly of the coupling mechanism of latching slide 2 and latch 3, as the connecting link guide 9 must simply be pushed into the recess of the latch 3 until the latching slide 2 snaps into the latch 3. Subsequently, both parts are automatically coupled to each other and ready for use.

The body 1 includes a rail in which the oblong carriage driver 5 can move. The rail hence encloses the profile of the carriage driver 5 which in turn encloses and fixes the toothed belt 22 of the door drive. The recess 4, in which the latch 3 is disposed, opens laterally towards the rail.

By means of the connecting link guide 9 the latch 3 can take two positions: an unlocking position and a locking position. The same each correspond to a free-wheeling position and a drive position of the latching slide 2.

In the free-wheeling position of the latching slide 2 the same is maximally retracted into the body 1 and the latch 3 contacts the broader part of the connecting link guide 9. The latch 3 thereby is pressed into the recess 4 against the tension of the spring 8 to such an extent that the latch 3 does not protrude into the rail in which the carriage driver 5 can move. This is the unlocking position of the latch 3, in which the carriage driver 5 can freely move through the rail of the body 1 and in which carriage driver 5 and body 1 are not and cannot be coupled to each other. In this configuration the drive carriage thus is decoupled from the door drive and the door connected to the door driver 6 can be moved manually.

Figure 4:
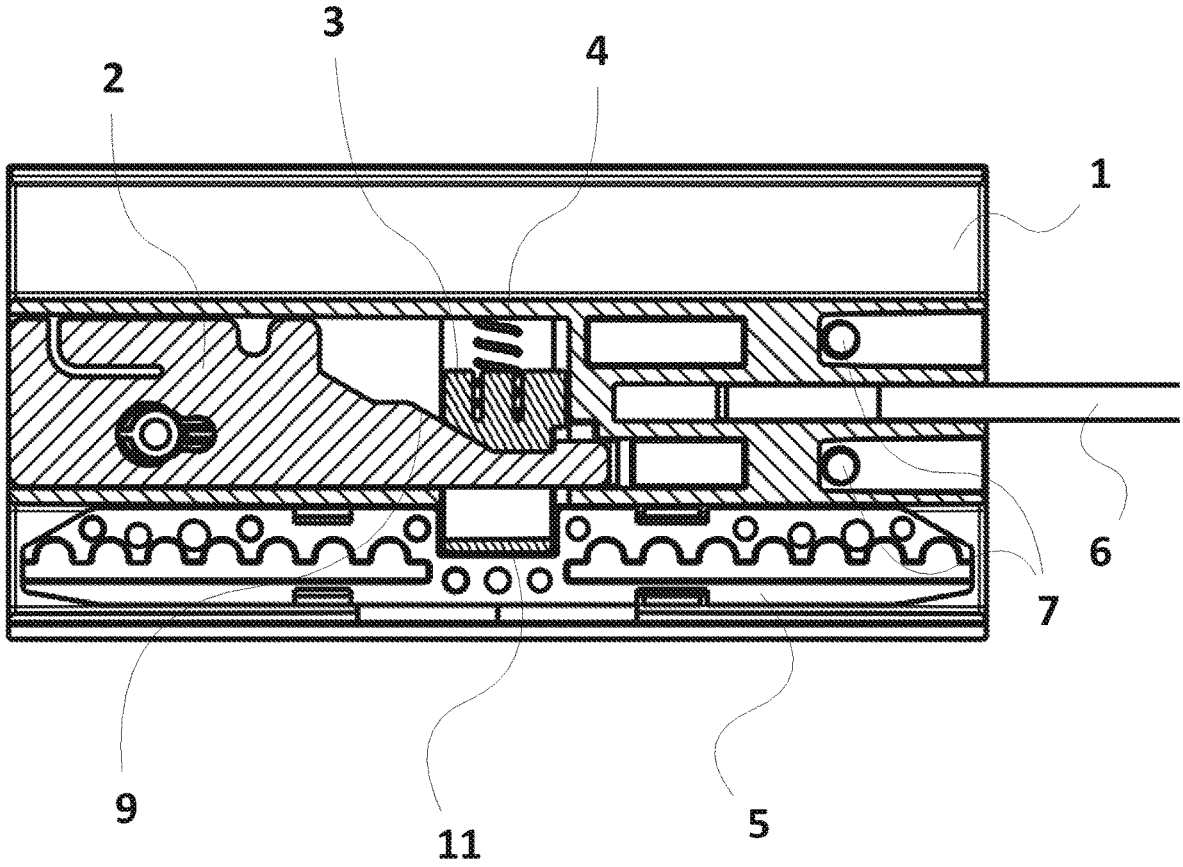
FIG. 4 shows the drive carriage as shown in FIG. 3 in a cross-sectional top view of the underside of the body.

In the drive position of the latching slide 2 the same is maximally away from the latch 3 so that the latching nose abuts against the side of the latch 3 facing away from the latching slide 2, whereby a further pushing out of the latching slide 2 is prevented (see FIG. 4). Corresponding to the smaller width of the connecting link guide 9 in the region of the latching nose the latch 3 is not pressed into the recess 4 as far as in the locking position. The latch 3 is in the unlocking position, in which the same is pressed into the rail by the spring 8. When the carriage driver 5 now is moved through the rail of the body 1, there will be a contact with the part of the latch 3 protruding from the recess 4.

At its front and rear ends (as seen in the direction of its linear movement) the carriage driver 5 has bevels which are bevelled in the direction facing the latch 3. Due to a retraction of the carriage driver 5 into the rail, while the latch 3 is in the locking position, the latch 3 thereby is pressed into the recess 4 against the tension of the spring 8 so that the carriage driver 5 can move in the rail and is not blocked by the latch 3.

Furthermore, the carriage driver 5 has a recess 11 on the side facing the latch 3, which corresponds to the profile or cross-section of the latch 3 or is larger than the same so that the latch 3 completely fits into this recess 11. When the recess 11 of the carriage driver 5 now is located at the level of the latch 3, the same is pressed into the recess 11 of the carriage driver 5 by means of the spring 8, which carriage driver thereby is locked at the body 1. Now, there exists an in particular positive coupling between body 1 and carriage driver 5. Thereby, a mechanical connection between the toothed belt 22 inserted or fixed in the carriage driver 5 and the drive carriage and thus with the door articulated to the door driver 6 is produced.

Figure 3:
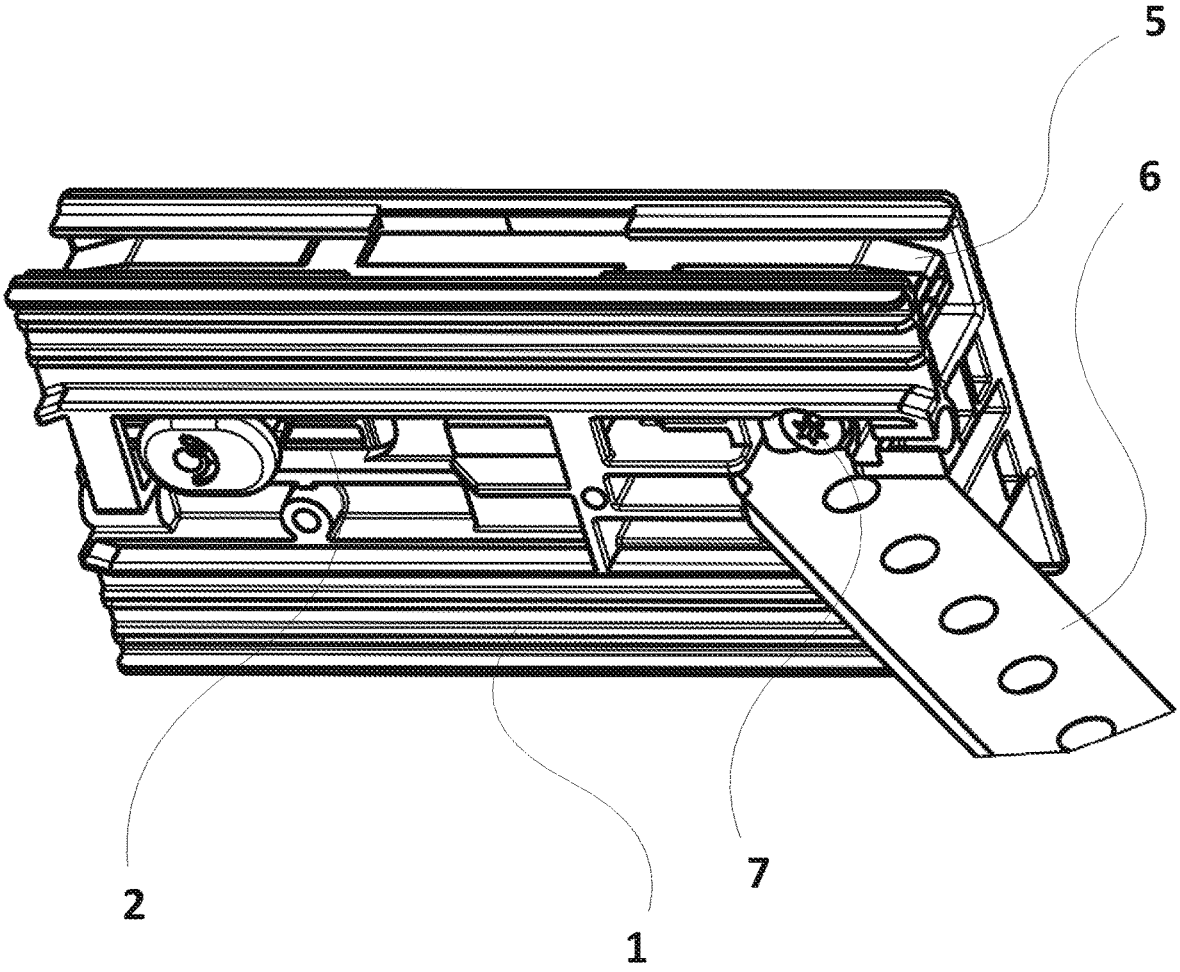
FIG. 3 shows the drive carriage as shown in FIG. 2 in an assembled condition.

FIGS. 3 and 4 show the mounted drive carriage with the latching slide 2 in the drive position. The carriage driver 5 is completely pushed into the rail of the body 1 and locked in this position by means of the latch 3 not visible here, which is in the locking position. In the body 1 the door driver 6 is fixed by the screws 7 by means of the bolt element 23 not visible in the sketch and is pivotally mounted about the longitudinal axis of the bolt element 23.

FIG. 4 illustrates the mode of action of the locking within the drive carriage. The latch 3 is located in the recess 4 and is pressed into the recess 11 of the carriage driver 5 by the spring 8. Furthermore, the mode of action of the latching slide 3 is illustrated here: In the drive position shown here, the same releases the latch 3 so that the same can be pressed into the recess 11 of the carriage driver 5 by means of the spring 8. When the latching slide 2 is pushed into the free-wheeling position against the spring force of the spring 8 of the latch 3, the locking is released and the body 1 can move independent of the carriage driver 5 and thus of the toothed belt 22 and the drive motor 21 connected thereto.

Latching slide 2 and latch 5 hence mutually hold or fix each other, and the latching slide 2 must be pushed from the drive position into the free-wheeling position against the spring force of the spring 8. Thus, it is prevented that the coupling between body 1 and carriage driver 5 is released inadvertently. The latching slide 2 furthermore includes a receiving device for receiving an actuating element by means of which the latching slide 2 can be moved over a certain distance from the free-wheeling position into the drive position and vice versa. This can be accomplished for example manually, but also automatically or by means of an actuator so that the motorized or manual operation of the door can easily be selected by the user. The actuating device for example can be a cable which includes a knot, a ball or a similar element which prevents slipping out of the receiving device. Furthermore, there is provided a securing device 10 in the form of a securing cap which serves the fixation of an actuating element which cannot be held by the receiving device alone, for example of a cable without knot or ball. The securing cap 10 includes an opening for the actuating element and after insertion of the actuating element is placed onto the receiving device of the latching slide 2.

As can be seen in FIG. 4, the region of the latch 3 contacting the connecting link guide 9 is bevelled in this exemplary embodiment in order to correspond with correspondingly bevelled regions of the connecting link guide 9 of the latching slide 2. This contacting region of the latch 3 is guided, in particular positively guided along the connecting link guide 9 when the latching slide 2 is brought from the free-wheeling position into the drive position and vice versa.

LIST OF REFERENCE NUMERALS

1 body
2 latching slide
3 latch
4 recess for latch in the body
5 carriage driver
6 door driver
7 screws
8 flexible element
9 connecting link guide

10 securing device for actuating element
11 recess for latch in the carriage driver
20 rail (door drive)
21 drive motor (door drive)
22 power transmission device (door drive)
23 bolt element

The invention claimed is:

1. A drive carriage for a door, comprising:
a body which is linearly shiftably mountable in a rail of a door drive, and
a door driver which is pivotally mounted on or in the body and is connectable with the door,
a carriage driver which is shiftable relative to the body and is connectable with a power transmission device of the door drive,
a latch which is mounted in the body via a flexible element and is pushable into a corresponding recess of the carriage driver by the flexible element when the carriage driver is in a position where the recess overlaps the latch, and
a latching slide, which:
in a free-wheeling position, the latching slide pushes the latch against the flexible element into an unlocking position in which the latch is pulled out of the recess of the carriage driver, and
in a drive position, the latching slide retracts permitting the flexible element to push of the latch into the recess of the carriage driver to take a locking position in which the carriage driver is coupled with the body.

2. The drive carriage according to claim 1, wherein the latching slide includes a connecting link guide along which the latch is positively guided when the latching slide is brought from the free-wheeling position into the drive position and vice versa.

3. The drive carriage according to claim 1, wherein a direction of movement of the latching slide when switching between the free-wheeling position and the drive position is perpendicular to the direction of movement of the latch when switching between locking position and unlocking position.

4. The drive carriage according to claim 1, wherein the latching slide includes a latching nose which prevents a release of a connection between the latching slide and latch.

5. The drive carriage according to claim 1, wherein the latching slide includes a receiving device for receiving an actuating element by means of which the latching slide is brought from the free-wheeling position into the drive position and vice versa.

6. The drive carriage according to claim 5, wherein the latching slide includes a securing device which fixes the actuating element on or in the receiving device and the actuating element moving the latching slide between the free-wheeling and drive positions.

7. The drive carriage according to claim 1, wherein the body comprises a rail into which the carriage driver is retractable and is shiftably mounted relative to the body.

8. The drive carriage according to claim 7, wherein in a second locking position the latch protrudes into the rail and the carriage driver does not protrude into the rail.

9. The drive carriage according to claim 8, wherein the carriage driver includes bevels by which the latch disposed in the locking position is pressed into the body against the flexible element on insertion of the carriage driver into the rail of the body, wherein the relative movement between carriage driver and body can be continued until the recess is located at a level of the latch and the same is pressed into the recess by the flexible element.

10. The drive carriage according to claim 7, wherein the rail is aligned parallel to a direction of movement of the drive carriage in the door drive.

11. The drive carriage according to claim 1, wherein the latching slide engages into a recess of the latch and by form fit delimits a movement of the latch enabled by the flexible element.

12. The drive carriage according to claim 1, wherein the body is designed in one piece.

13. The drive carriage according to claim 1, wherein the flexible element is a spring.

14. The drive carriage according to claim 1, wherein the latching slide, latch, carriage driver and body are made of plastics.

15. The drive carriage according to claim 1, wherein the door driver is configured as a rod and includes a bolt element at an end facing away from the door, by means of which the door driver is releasably mounted in a recess of the body and pivotable about the longitudinal axis of the bolt element.

16. The drive carriage according to claim 1, wherein the door is for a garage door.

17. A door drive for a door, comprising:
a drive motor,
a rail,
a power transmission device, and
a drive carriage, comprising:
a body which is linearly shiftably mountable in the rail, and
a door driver which is pivotally mounted on or in the body and is connectable with the door,
a carriage driver moveable relative to the body and the carriage driver connectable with the power transmission device of the door drive,
a latch which is mounted in the body via a flexible element is pushable into a corresponding recess of the carriage driver by the flexible element when the carriage driver is in a position where the recess aligns with the latch, and
a latching slide engages into a recess of the latch and delimits a movement of the latch, and
in a free-wheeling position, the latching slide urges the latch against the flexible element into an unlocking position in which the latch is not pushed into the recess by the flexible element, and
in a drive position, the latching slide permits pushing of the latch into the recess of the carriage driver by the flexible element in order to take a locking position in which the carriage driver is coupled with the body,
wherein the door drive is linearly movable by means of the power transmission device.

18. The door drive according to claim 17, wherein the door is for a garage, and wherein the power transmission device is a toothed belt.

19. The door drive according to claim 17, wherein the body is formed of a single piece.

* * * * *